United States Patent [19]

Fresquez

[11] 4,131,406

[45] Dec. 26, 1978

[54] TOOLS FOR MAKING IMPRESSIONS IN HARDENABLE MATERIALS

[76] Inventor: George A. Fresquez, 4883 Fond du Lac Ct., San Diego, Calif. 92117

[21] Appl. No.: 840,837

[22] Filed: Oct. 11, 1977

[51] Int. Cl.[2] ..... E04G 11/06; B28B 11/10

[52] U.S. Cl. ..... 425/385; 425/318; 425/295; 425/298; 249/15; 249/16

[58] Field of Search ..... 249/13, 15, 16; 425/90, 425/91, 318, 385, 295, 298, 299

[56] References Cited

U.S. PATENT DOCUMENTS

| | | | |
|---|---|---|---|
| 949,957 | 2/1910 | Falk | 425/299 |
| 1,147,704 | 7/1915 | Bruckner | 249/16 X |
| 2,194,289 | 3/1940 | Barnes | 249/16 X |
| 2,517,432 | 8/1950 | Hornberger | 249/15 X |
| 2,550,194 | 4/1951 | Jackson | 249/15 |
| 2,616,145 | 11/1952 | Dufford | 249/15 |

*Primary Examiner*—J. Howard Flint, Jr.
*Attorney, Agent, or Firm*—Brown & Martin

[57] ABSTRACT

The tool incorporates a plurality of penetrating blades arranged in a stamping plane. The blades are secured to a platform grid. The blades paralleling an edge of the platform form a closed end of the tool. The blades taper from the platform attached portion to a penetrating tip forming a tapering transverse profile. Blades terminating opposite the closed end of the tool include a mating blade face having a longitudinal profile complimentary to the transverse profile so that when the tool is positioned against other similar tools in making impressions, the closed end-to-open end interface is made without gaps or voids thereby eliminating hand work in the finishing operation.

2 Claims, 6 Drawing Figures

TOOLS FOR MAKING IMPRESSIONS IN HARDENABLE MATERIALS

BACKGROUND OF THE INVENTION

Tools for stamping concrete and similar materials have been employed for many years. Such tools have frequently been platform tools designed to be utilized in conjunction with a plurality of similar tools and operated by workmen walking on the platform and tamping the tool into the surface of the concrete using a striking driver. The platform tools incorporate penetrating blades arranged in patterns to simulate bricks, tiles and other conventional materials. To mate between adjacent tools and patterns, at least one of the blades normally parallels the edge of the platform thus forming a closed end of the tool. Since the blades are generally tapered toward the tip, then the closed end of the tool makes a slopting impression in the hardening concrete. The ends of the blades terminating opposite the closed end terminate in a vertical surface. Accordingly, when an adjacent tool is layed up against the platform of a first tool, a sloping surface-to-vertical surface mating relationship is produced, leaving a gap or void which fills with hardening concrete. This concrete must be worked out by hand tools. The hand tool or "tinkering" operation, as it is known, considerably slows the production of imprinted concrete and increases the cost thereof.

In one prior art tool, as is described in more detail in U.S. Pat. No. 3,406,618, the problem was addressed by providing fillets on the closed face of the tool. However, these fillets are susceptible to damage in use, and are difficult to align with the corresponding blades on an adjacent tool. As a result, the use of this tool slows production.

Therefore, it is desirable to have a tool for making impressions in hardenable materials that eliminates the need for hand tool operations at the closed end-open end interface between adjacent tools and doesn't slow production. Such a tool is particularly desirable where it does not reduce the overall integrity of the resulting tool or substantially increase its manufacturing cost.

SUMMARY OF THE INVENTION

In an exemplary embodiment of the invention, the deficiencies of prior art devices are overcome by altering the conventional blade end faces on the blades terminating opposite the closed end of the tool. The blade end faces are formed with a longitudinal profile that is complimentary to the trasverse profile of the closed end. Accordingly, when like tools are placed adjacent, the terminal blade faces on the open end mate with the transverse profile of the blades on the closed end adjacent tool leaving no gaps or voids between the two tools and eliminating any need for hand tool operations. Such a tool is particularly advantageous over prior art tools in that no additional parts need be molded or otherwise formed in the basic tool.

Whereas the exemplary embodiment is described in association with a platform tool similar to platform tools according to conventional construction, it should be understood that the invention may be applied to a flexible and/or non-metal tool utilized in so-called matting operations where a plurality of tools are locked together and pressed into the surface of the hardenable material by a heavy roller, vibratory tamper or other implement.

As used herein, hardenable materials contemplates conventional concrete as well as other hardenable materials such as stucco, plaster and soil harded by chemicals.

It is therefore an object of the invention to provide a new and improved tool for making impressions in hardenable materials and for reducing the hand work necessary. The tool according to the invention contains no new parts or separate protrusions of the tool which would be subject to damage and would increase the cost of molding and subsequent forming operations. The portions of the tool utilized for eliminating the hand tool operations are less susceptible to damage since they form an integral extension of the imprinting blades. Since the blades mate with the closed end of the tool, no time consuming alignment is necessary.

Other objects and many attendant advantages of the invention will become more apparent upon a reading of the following detailed description together with the drawings in which like reference numerals refer to like parts throughout and in which:

DETAILED DESCRIPTION OF THE DRAWINGS

Figure 1:
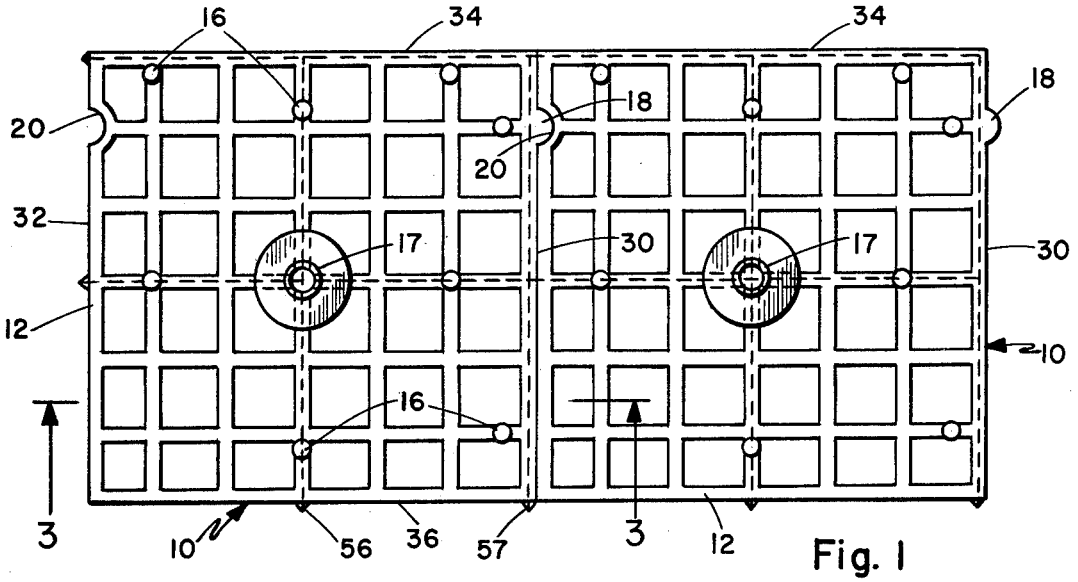
FIG. 1 is a top plan view of two interfitted platform tools for applying a tile pattern.
Figure 2:
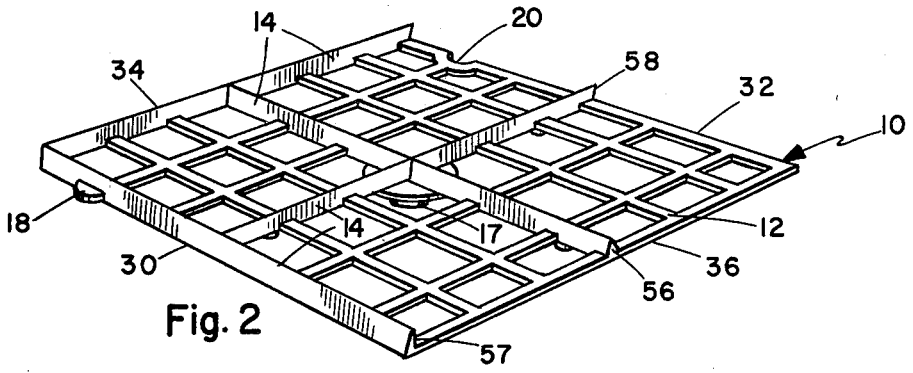
FIG. 2 is a perspective view of the underside of one platform tool.

Referring now to the drawings, there is illustrated a platform tool 10 according to the invention. The platform tool is utilized in making a square tile pattern and therefore has a plurality of penetrating blades 14 arranged with two blades 14 parallel to and adjacent to the edge of the tool and thereby forming closed tool ends 30 and 34. The several blades 14 are secured to the platform grid 12. The top surface of the tool is illustrated in FIG. 1 showing a plurality of strike pads 16 which are utilized for tamping the tool into the surface of the hardenable material. A handle mount 17 is illustrated to which a handle (not shown) is attached for moving the tools and withdrawing them after the penetration is complete. Two tools 10 are shown in the mating relationship utilized. Adjacent tools 10 are aligned by interlocks so that the blade relationship is maintained consistent throughout the entire treated surface. The interlocks comprise extensions 18 which protrude from the closed end of one tool and recesses 20 which are provided on the corresponding complimentary portion of adjacent tools.

Figure 4:
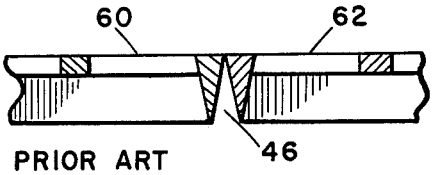
PRIOR ART Fig. 4
FIG. 4 is a sectional view similar to a portion of FIG. 3, showing the junction of two platform tools according to the prior art.

As noted above, the blades 14 parallel and are adjacent the edge of the platform grid 12 form closed ends 30 and 34. Opposite the closed ends 30 and 34 are open ends 32 and 36. The blades 14 terminate at the open ends in sloping blade mating faces 56, 57 and 58. If the blades 14 terminated in a flat surface as would be suggested by conventional practice, then when the tool was utilized in a stamping operation with an adjacent tool, a gap would exist between the mating surface open end blades and closed end blades. This gap is illustrated in FIG. 4. A prior art platform tool 60 is shown adjacent a platform tool 62. The open-closed end interface results in a gap 46. When such tools are pressed into the surface of the hardenable materials, such as concrete, the concrete is forced up into the gap 46. After the tools are removed, the unwanted concrete must be worked out of the groove by hand tools.

Figure 3:
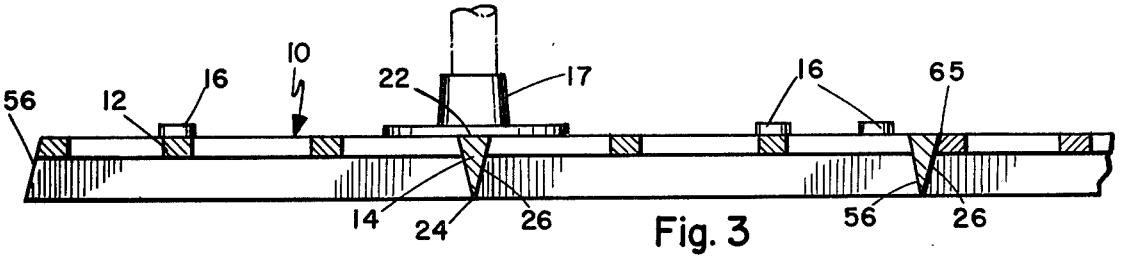
FIG. 3 is an enlarged sectional view taken on line 3—3 of FIG. 1.

In contrast to the conventional practice, the blade mating faces 56, 57 and 58 are formed with a mating face complimentary to the closed tool end. The shape of the mating face is illustrated in FIG. 3, where the profile of the blade face 56 is illustrated. Also illustrated in FIG. 3 is the transverse section of a blade 14 showing the platform attachment portion 22 which tapers over the length of the blade to the tip 24 producing a profile 26. The profile 26 is the compliment of the mating face 56. Accordingly, when two tools 10 are placed adjacent, in position for forming concrete, (illustrated in FIG. 3), the face 56 mates with the profile 26 to produce a open-end, closed-end interface 65 with no gaps.

Figure 5:
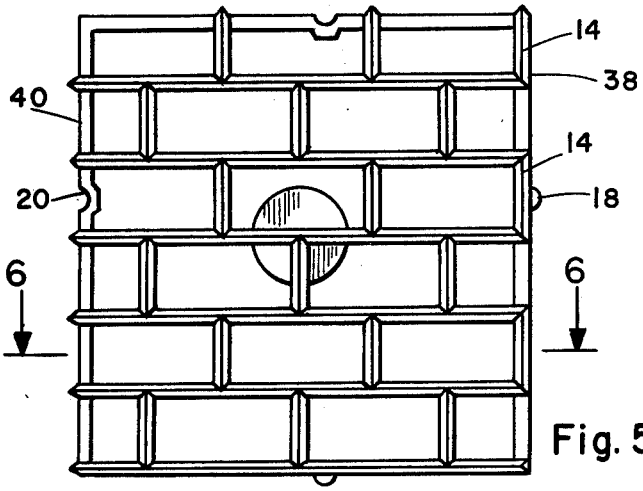
FIG. 5 is a bottom plan view of an alternative platform for applying a running bond brick pattern.
Figure 6:
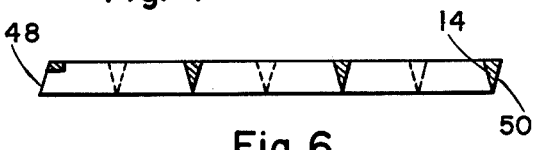
FIG. 6 is a sectional view taken on line 6—6 of FIG. 5.

Referring to FIG. 5, a modified form of the invention is illustrated. in FIG. 5, the tool has been designed to produce a simulated running bond brick pattern. To produce such a pattern, the closed end of the tool 38 has a number of short segments of blades 14 parallel to the edge of the platform. The corresponding terminal portions of the blades 14 adjacent the open end 40 of the tool are made to butt against an adjacent tool at its closed end 38. Accordingly, if such a tool were designed according to conventional practice, hand tooling at each of the blade to closed end interfaces would be required. In a running bond brick pattern according to that illustrated in FIG. 5, this would necessitate nine hand tooling operations for each platform tool. However, when manufactured according to the practice of the invention, the blade terminuses, such as those terminating at the open end 40 of the tool, are made with the mating face profile 48 (see FIG. 6), which corresponds to the platform to tip profile 50 on the closed faces of the tool. It will be apparent that the practice of the invention can be extended to any pattern design. So long as the invention is applied consistently to the closed end-open end interfaces, the requirement for hand tooling is substantially eliminated.

Having described my invention, I now claim:

1. A tool for making impressions in hardenable materials comprising:

blade means comprising a plurality of elongated blades lying substantially in a stamping plane, a platform grid, said blade means being secured to said platform grid, means for pressing said blade means into said hardenable materials, said blade means having a penetrating tip and a platform attachment portion, said platform attachment portion having substantially greater width than said penetrating tip producing a tapering platform-to-tip transverse profile, at least a portion of one of said blades lying adjacent an edge of said platform and forming a closed end of said tool, at least one of said blades terminating in a mating blade face adjacent an edge opposite said closed end of said tool, said mating blade face having a longitudinal profile complimentary to said transverse profile.

2. The tool for making impressions in hardenable materials according to claim 1 wherein:

a plurality of blades terminate in said mating blade faces.

* * * * *